US010323656B2

(12) United States Patent
Bertoneri et al.

(10) Patent No.: US 10,323,656 B2
(45) Date of Patent: Jun. 18, 2019

(54) EXTRACTING DRY GAS FROM A WET-GAS COMPRESSOR

(71) Applicant: Nuovo Pignone Srl, Florence (IT)

(72) Inventors: Matteo Bertoneri, Florence (IT); Giuseppe Vannini, Florence (IT)

(73) Assignee: Nuovo Pignone Srl, Florence (IT)

( * ) Notice: Subject to any disclaimer, the term of this patent is extended or adjusted under 35 U.S.C. 154(b) by 374 days.

(21) Appl. No.: 15/313,197

(22) PCT Filed: May 22, 2015

(86) PCT No.: PCT/EP2015/061423
§ 371 (c)(1),
(2) Date: Nov. 22, 2016

(87) PCT Pub. No.: WO2015/181082
PCT Pub. Date: Dec. 3, 2015

(65) Prior Publication Data

US 2017/0211595 A1 Jul. 27, 2017

(30) Foreign Application Priority Data

May 26, 2014 (IT) ..... FI2014A0123

(51) Int. Cl.
*F04D 29/70* (2006.01)
*F04D 29/58* (2006.01)
(Continued)

(52) U.S. Cl.
CPC ..... *F04D 29/706* (2013.01); *F04D 17/12* (2013.01); *F04D 25/06* (2013.01); *F04D 29/058* (2013.01);
(Continued)

(58) Field of Classification Search
CPC ..... F04D 29/706; F04D 17/12; F04D 25/06; F04D 29/286; F04D 29/4206;
(Continued)

(56) References Cited

U.S. PATENT DOCUMENTS 6,171,074 B1 1/2001 Charron
2010/0135769 A1 6/2010 Kleynhans et al.
2012/0230812 A1* 9/2012 Jonen ..... B01D 45/06 415/13

FOREIGN PATENT DOCUMENTS

CN 102119052 A 7/2011
SU 1430611 A1 10/1988

OTHER PUBLICATIONS

First Office Action and Search issued in connection with corresponding CN Application No. 201580027700.2 dated Jun. 5, 2018 (English Translation not available).
(Continued)

*Primary Examiner* — Jacob M Amick
(74) *Attorney, Agent, or Firm* — Baker Hughes Patent Operations

(57) ABSTRACT

A wet-gas centrifugal compressor is disclosed. The compressor comprises a compressor casing and at least one impeller arranged in the compressor casing for rotation around a rotation axis. A stationary diffuser is arranged in the compressor casing and extends around the impeller. The diffuser has a curved end portion with a radially inner curved wall and a radially outer curved wall. A plurality of dry-gas extraction holes is provided, ending at a plurality of respective inlet ports arranged around the rotation axis and on the inner curved wall of the curved end portion of the diffuser. Each dry-gas extraction hole extends from the respective inlet port towards the rotation axis and is inclined over a radial direction, such that each dry-gas extraction hole is
(Continued)

oriented in a counter-flow direction with respect to a direction of the gas flow in the curved end portion of the diffuser.

21 Claims, 5 Drawing Sheets

(51) Int. Cl.

| | |
|---|---|
| ***F04D 29/08*** | (2006.01) |
| ***F04D 29/058*** | (2006.01) |
| ***F04D 29/44*** | (2006.01) |
| ***F04D 17/12*** | (2006.01) |
| ***F04D 25/06*** | (2006.01) |
| ***F04D 29/28*** | (2006.01) |
| ***F04D 29/42*** | (2006.01) |
| *F04D 27/02* | (2006.01) |

(52) U.S. Cl.
CPC ..... *F04D 29/083* (2013.01); *F04D 29/286* (2013.01); *F04D 29/4206* (2013.01); *F04D 29/441* (2013.01); *F04D 29/586* (2013.01); *F04D 27/023* (2013.01); *F05D 2210/13* (2013.01); *F05D 2250/52* (2013.01)

(58) Field of Classification Search
CPC ..... F04D 29/441; F04D 29/08; F04D 29/083; F04D 29/124; F04D 29/128; F04D 29/586
See application file for complete search history.

(56) References Cited

OTHER PUBLICATIONS

Decision to Grant a Patent issued in connection with corresponding RU Application No. 2016143919 dated Nov. 1, 2018.
International Search Report and Written Opinion dated May 9, 2016 which was issued in connection with PCT Patent Application No. PCT/EP2015/061423 which was filed on May 22, 2015.
Italian Search Report and Written Opinion dated Sep. 4, 2014 which was issued in connection with Italian Patent Application No. FI2014A000123 which was filed on May 26, 2014.

* cited by examiner

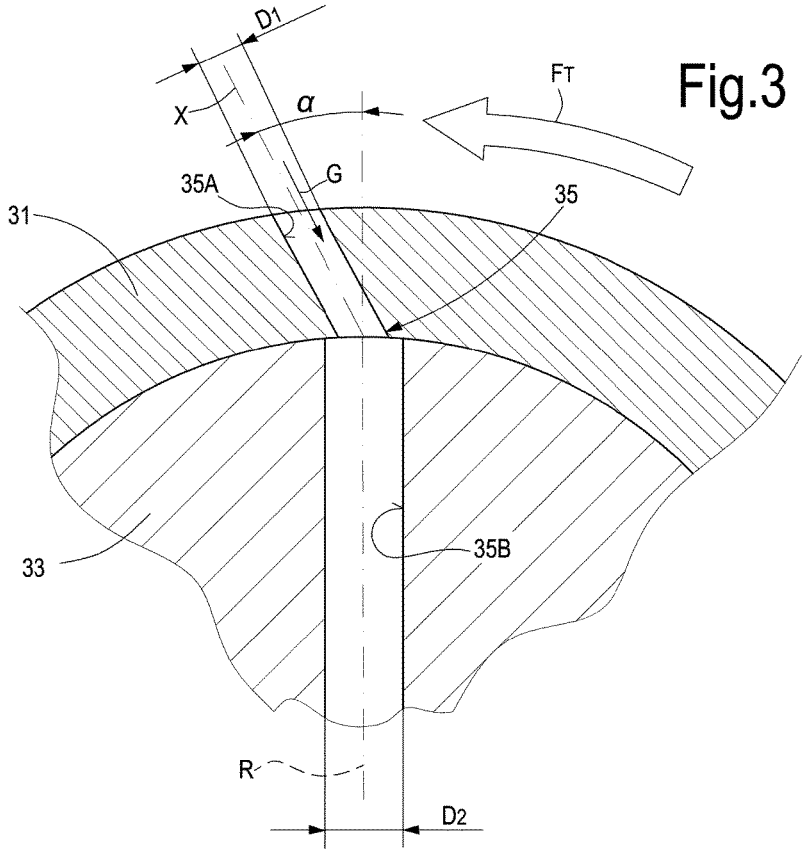
Fig.3
Fig.4
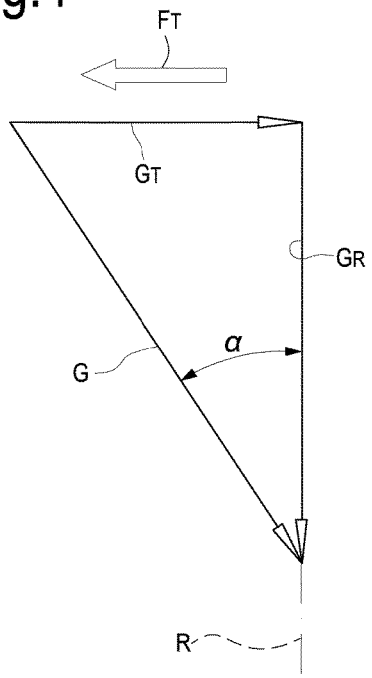
Fig.5
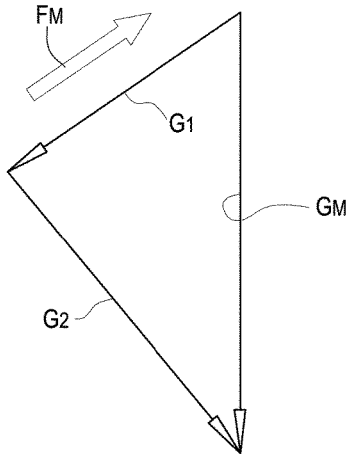

EXTRACTING DRY GAS FROM A WET-GAS COMPRESSOR

BACKGROUND

The present disclosure relates to compressors and specifically to turbo-compressors. Embodiments disclosed herein relate to so-called wet-gas turbo-compressors, i.e. turbomachines which are designed for processing a gas, which contains liquid contaminants in the form of droplets, and sometimes also solid contaminants.

Turbomachines contain elements, which are particularly sensitive to solid and/or liquid particles. Typical components, which must be protected against the penetration of solid and/or liquid matter in a turbomachine, such as a centrifugal compressor, include, but are not limited to, active magnetic bearings, oil bearings, electric motors and the like. Typically, such components can be integrated in a turbomachine casing, e.g. in a compartment, which is separated by a compartment housing the compressor impellers and wherein wet gas is processed.

Sealing arrangements and devices are usually provided to separate a first compartment containing the compressor impellers from adjacent compartments containing contaminant-sensitive components, such as bearing and electric motors. In some known embodiments buffer seals are used for isolating a compartment containing one or more contaminant-sensitive components from a compartment containing the compressor, and more specifically the compressor impellers, through which contaminated gas, i.e. gas containing contaminants in the form of liquid and/or solid particles, is processed.

Dry gas is delivered to the buffer seals, to generate a gas barrier between the two compartments aimed at preventing the ingress of contaminants from the compressor compartment into the protected compartments containing the contaminant-sensitive component(s) of the compressor.

Dry gas is also used in so-called dry gas seals, which are provided for effectively separate a compressor inner volume from the surrounding environment, for example.

Dry gas is sometimes provided from an external source of clean gas. Particularly in off-shore installations providing a source of clean dry gas is, however, costly exercise, since no such source is available near the off-shore installation. Systems have therefore been developed, which use the same gas processed by the compressor to provide dry gas to the buffer seals. Gas is extracted from the compressor, cleaned and conditioned in a dry gas skid or the like and subsequently delivered to the buffer seals.

There is still a need for improving these systems and more efficiently provide various components of the compressor with dry gas extracted from the main gas flow processed by the compressor.

Brief Description

According to one aspect, the present disclosure concerns a wet-gas centrifugal compressor, comprising a compressor casing and at least one impeller arranged in the compressor casing for rotation around a rotation axis. The compressor further comprises a stationary diffuser arranged in the compressor casing and developing around the impeller. The diffuser comprises a curved end portion with a radially inner curved wall and a radially outer curved wall. The shape of the inner and outer curved walls is such that longitudinally, i.e. in a plane containing the rotation axis, the inner curved wall has a smaller radius of curvature than the outer curved wall. For extracting dry gas from the main gas flow processed through the impeller, a plurality of dry-gas extraction holes is provided. The holes are provided each with a respective inlet port. The inlet ports are arranged circumferentially, i.e. around the rotation axis, and on the inner curved wall of the curved end portion of the diffuser. Moreover, each dry-gas extraction hole extends from the respective inlet port towards the rotation axis and is inclined over a radial direction, such that at least the first portion of each dry-gas extraction hole, i.e. at the inlet port thereof, is oriented in a counter-flow direction with respect to a direction of the gas flow in the curved end portion of the diffuser.

According to a further aspect, the disclosure concerns a wet-gas centrifugal compressor, comprising a compressor casing and a plurality of sequentially arranged impellers, arranged in the compressor casing for rotation around a rotation axis. The compressor further comprises a respective stationary diffuser arranged in the compressor casing and developing around each impeller, each diffuser having a curved end portion with a radially inner curved wall and a radially outer curved wall. Longitudinally, i.e. in a meridian plane containing the rotation axis, the inner curved wall has a smaller radius of curvature than the outer curved wall. A plurality of dry-gas extraction holes is further provided. Each hole is provided with a respective one of a plurality of inlet ports arranged circumferentially, i.e. around the rotation axis, and on the inner curved wall of the curved end portion of the diffuser of the most downstream impeller. Each dry-gas extraction hole extends from the respective inlet port towards the rotation axis and is inclined over a radial direction, such that at least in the first portion, i.e. at the inlet port, each dry-gas extraction hole is oriented in a counter-flow direction with respect to a direction of the gas flow in the curved end portion of the diffuser.

Dry gas can be extracted in the area of the diffuser, where gas has a temperature and pressure higher than at the impeller inlet. Dry gas as understood herein is a gas which has a reduced or no liquid or solid content therein. The counter-flow arrangement of the dry-gas extraction holes reduces or substantially eliminates at least part of the liquid/solid particles dragged by the main gas flow, thus reducing the amount of liquid or solid particles in the extracted gas flow.

According to a further aspect, disclosed herein is a method for providing a dry-gas flow to a component in a wet-gas centrifugal compressor comprised of: a compressor casing; at least one impeller arranged in the compressor casing for rotation around a rotation axis; a stationary diffuser arranged in the compressor casing and developing around the impeller, the diffuser having a curved end portion with a radially inner curved wall and a radially outer curved wall, in a sectional plane containing the rotation axis, i.e. in a meridian plane, the inner curved wall having a smaller radius of curvature than the outer curved wall. The method comprises the following steps: providing a plurality of dry-gas extraction holes, each provided with a respective inlet port, the inlet ports arranged circumferentially, i.e. around the rotation axis, and on the inner curved wall of the curved end portion of the diffuser; each dry-gas extraction hole extending from the respective inlet port towards the rotation axis and being inclined over a radial direction, such that at least at the respective inlet port each dry-gas extraction hole is oriented in a counter-flow direction with respect to a direction of the gas flow in the end portion of the diffuser; extracting a dry-gas flow through the dry-gas extraction holes; and delivering the dry-gas to a component of the centrifugal compressor.

According to yet a further aspect, a method is disclosed for providing a dry-gas flow to a component in a wet-gas centrifugal compressor comprised of: a compressor casing; a plurality of impellers arranged in the compressor casing for rotation around a rotation axis; for each impeller, a stationary diffuser arranged in the compressor casing and developing around the respective impeller, each diffuser having a curved end portion with a radially inner curved wall and a radially outer curved wall, in a meridian plane, i.e. a plane containing the rotation axis, the inner curved wall having a smaller radius of curvature than the outer curved wall. The method comprises the following steps: providing a plurality of dry-gas extraction holes, each having a respective inlet port, the inlet ports arranged circumferentially, i.e. around the rotation axis, and on the inner curved wall of the curved end portion of the most downstream one of the diffuser; each dry-gas extraction hole extending from the respective inlet port towards the rotation axis and being inclined over a radial direction, such that at least at the respective inlet port each dry-gas extraction hole is oriented in a counter-flow direction with respect to a direction of the gas flow in the curved end portion of the diffuser; extracting a dry-gas flow through the dry-gas extraction holes; and delivering the dry-gas to a component of the centrifugal compressor.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein:

FIG. 3 illustrates a cross-sectional view according to line in FIG. 1;

FIGS. 4 and 5 illustrate diagrams of gas velocity vectors in a meridian plane and tangential plane, respectively;

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1:
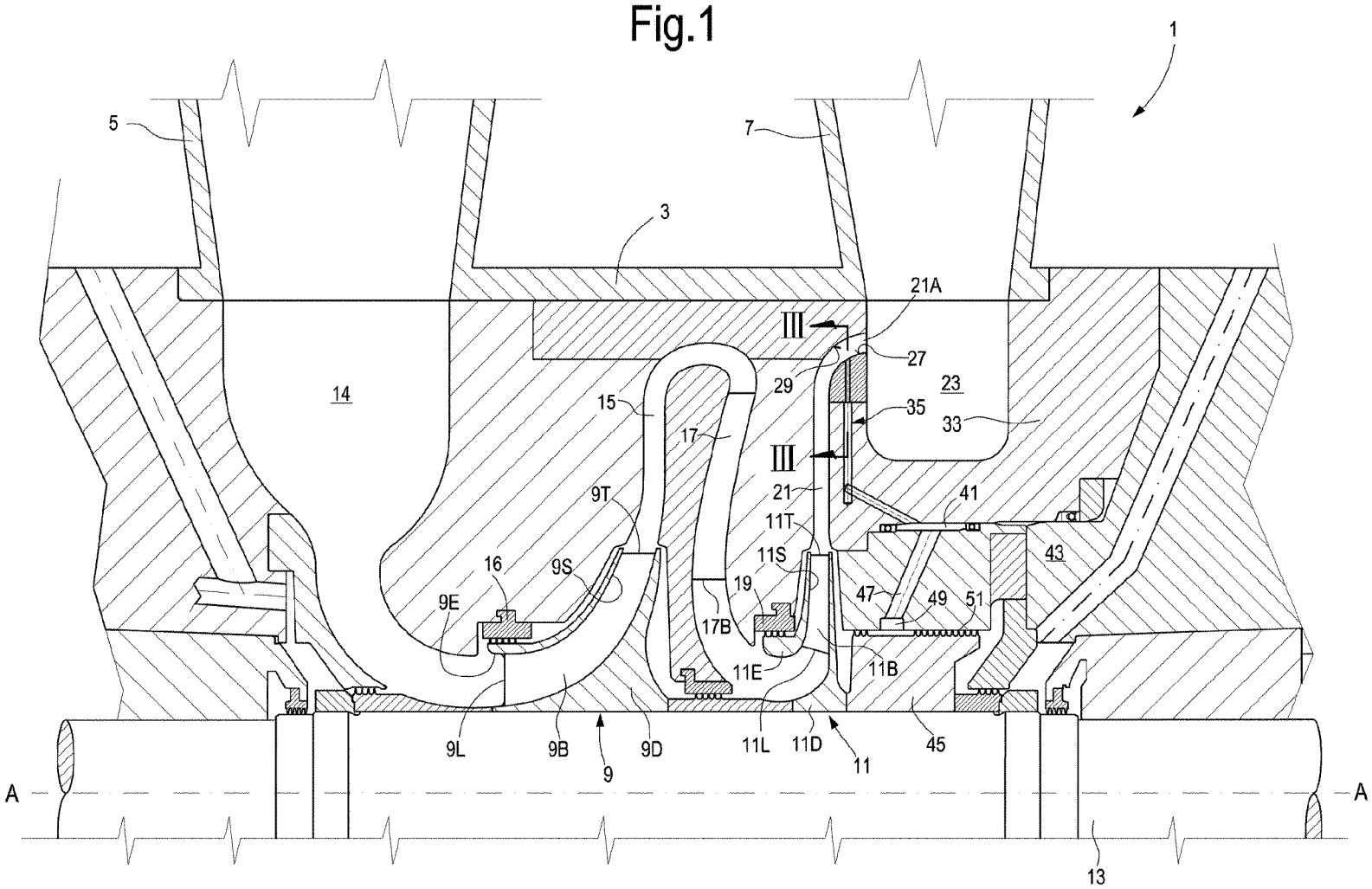
FIG. 1 illustrates a fragmentary sectional view of a centrifugal compressor according to the present disclosure in a first embodiment.

FIG. 1 illustrates a fragmentary sectional view of an exemplary embodiment of a multistage centrifugal compressor embodying the subject matter disclosed herein. In FIG. 1 the centrifugal compressor is labelled 1. The centrifugal compressor 1 comprises a compressor casing 3 having a gas inlet 5 and a gas outlet 7.

In the exemplary embodiment of FIG. 1 the centrifugal compressor 1 comprises a first impeller 9 and a second impeller 11 mounted on a shaft 13 for rotation therewith around a rotation axis A-A. The shaft 13 is supported in the compressor casing 3 by means of suitable bearing arrangements, not described herein in detail and known to those skilled in the art.

The gas inlet 5 is in fluidly coupled to a gas inlet plenum 14, wherefrom gas to be compressed is fed towards the first impeller 9. In the exemplary embodiment of FIG. 1 the first impeller 9 is a shrouded impeller and is comprised of an impeller disc 9D and an impeller shroud 9S with an impeller eye 9E. A sealing arrangement 16 co-acts with an impeller eye 9E preventing or limiting gas leakage from the impeller outlet back towards the impeller inlet. Between the impeller disc 9D and the impeller shroud 9S a plurality of impeller blades 9B is arranged, each provided with a trailing edge 9T and a leading edge 9L. Gas flowing through blade vanes defined between adjacent impeller blades 9B is accelerated from the leading edge 9L to the trailing edge 9T.

Downstream and around the first impeller 9 a diffuser 15 and a return channel 17 are arranged. Gas exiting the first impeller 9 flows through diffuser 15 and return channel 17 towards the inlet of the second impeller 11. In some embodiments the diffuser 15 and/or the return channel 17 can be bladed, i.e. provided with stationary blades, as shown at 17B in FIGS. 1 and 2. Accelerated gas from the first impeller 9 flows through the diffuser 15, where kinetic energy of the gas is at least partly converted into pressure energy, thus increasing the pressure of the gas which enters the second impeller 11.

In the embodiment of FIG. 1, the second impeller 11 comprises an impeller disc 11D, an impeller shroud 11S and a set of impeller blades 11B arranged therebetween and forming gas flow channels, where through the gas is accelerated. The impeller shroud 11S is provided with an impeller eye 11E, which co-acts with a sealing arrangement 19 preventing or limiting leakage or back-flow of compressed gas from the impeller outlet towards the impeller inlet. Reference numbers 11T and 11L designate the trailing edges and the leading edges of the blades 11B.

A diffuser 21 is arranged downstream and around the second impeller 11 and receives the gas flow therefrom. In some embodiments the diffuser 21 can be bladed, i.e. provided with stationary blades therein for guiding the gas flow. Gas flowing through the second impeller 11 is accelerated by the impeller 11 and is subsequently slowed down in the diffuser 21, where part of the kinetic energy of the accelerated gas is converted into pressure energy, boosting the gas pressure.

The diffuser 21 is fluidly coupled to a volute 23 surrounding the compressor shaft 13. The volute 23 is fluidly coupled to gas outlet 7, wherefrom compressed gas is delivered.

The diffuser 21 is comprised of a curved end portion 21A ending in the volute 23. The curved end portion 21A of the diffuser 21 has a radially inner curved wall 27 and a radially outer curved wall 29.

Figure 1A:
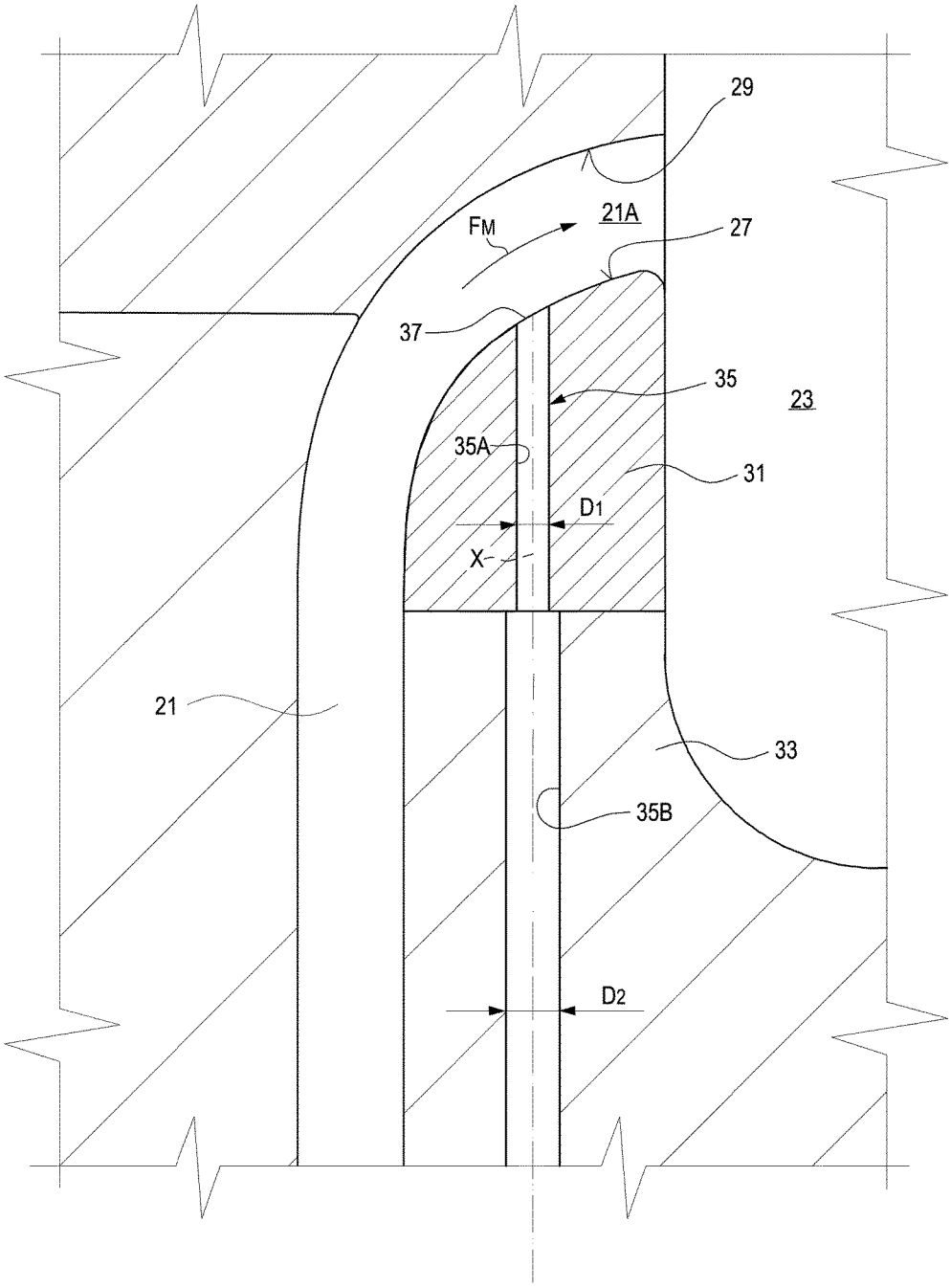
FIG. 1A illustrates an enlargement of a detail of FIG. 1.

As best shown in the enlargement of FIG. 1A, in some embodiments the radially inner curved wall 27 can be formed on an annular component 31, which can be manufactured separately from a diaphragm portion 33, which forms the reminder of the diffuser 21. The annular component 31 is then mounted on the diaphragm portion 33 and integrally connected therewith.

Dry-gas extraction holes 35 are provided in the stationary arrangement formed by the annular component 31 and the diaphragm portion 33. In some embodiments the dry-gas extraction holes 35 can be comprised of a first extraction hole portion 35A machined in the annular component 31 and a second extraction hole portion 35B machined in the diaphragm portion 33. The two extraction hole portions 35A, 35B of each dry-gas extraction hole 35 can have different diameters, as shown in D1 and D2 in FIGS. 1A and 3.

According to some embodiments, a plurality of dry-gas extraction holes 35 is arranged around the annular development of the stationary components 31, 33 around the rotation axis A-A of shaft 13. In FIG. 3 only some of the dry-gas extraction holes 35 are shown. It shall be understood that the number and therefore the angular pitch between adjacent dry-gas extraction holes 35 can vary according to needs and design constraints and considerations. In some embodiments, between 10 and 50 dry-gas extraction holes 35 can be provided.

In some embodiments the extraction hole portion 35A of each dry-gas extraction hole 35 can lie on a plane, which is substantially orthogonal to the rotation axis A-A as shown FIG. 1. In particular embodiments the orientation of the first extraction hole portion 35A of each dry-gas extraction hole 35 seen in the plane orthogonal to the rotation axis A-A is slanted with respect to the radial direction, as best shown in FIG. 3.

In a plane orthogonal to the rotation axis A-A the axis X of each extraction hole portion 35A forms an axis a with a radial direction R, as shown in FIG. 3. The orientation of the extraction hole portion 35A is such that the axis X of the extraction hole portion 35A is inclined with respect to the radial direction R in the same direction as the tangential gas velocity in the curved portion 21A of diffuser 21.

Each dry-gas extraction hole 35 has a gas inlet formed by a respective port 37 located on the radially inner curved wall 27. As will be explained in greater detail later on, a gas flow is diverted from the main gas flow in the diffuser 31 towards the dry-gas extraction holes 35 through ports 37, to provide a flow of dry gas.

In the exemplary embodiment of FIG. 1 the dry-gas extraction hole 35 extends towards an annular chamber 41 formed between the diaphragm portion 33 and an intermediate annular member 43, which surrounds a balancing drum 45 mounted for rotation on the compressor shaft 13. Gas flow passages 47 can be provided, which connect the cavity 41 to respective shunt holes 49 arranged around the balancing drum 45 and delivering a gas flow in a sealing arrangement 51.

When the compressor 1 is running, a main gas flow is processed through the first and second impellers 9 and 10. Gas at a lower pressure enters the compressor at the gas inlet 5 and is delivered at a higher pressure through the gas outlet 7.

The gas processed by the centrifugal compressor 1 can contain solid and/or liquid particles, for example liquid droplets of a hydrocarbon, or a mixture of hydrocarbons, having a high molecular weight, dispersed in a main flow of a gaseous hydrocarbon, or a mixture of hydrocarbons, having a lower molecular weight.

Gas to be provided at the shunt holes 49 surrounding the balancing drum 45 must be possibly free of solid/liquid particles. The configuration and arrangement of the dry-gas extraction holes 35 reduces or eliminates the amount of liquid and/or solid particles from the gaseous flow diverted from the diffuser 21 towards the dry-gas extraction holes 35. This is accomplished by the location and orientation of the extraction hole portions 35A with respect to the orientation of the gas velocity vector in the curved end portion 21A of diffuser 21.

As best shown for example in FIG. 3, gas entering the dry-gas extraction holes 35 has a velocity (represented by vector G), which is substantially parallel to the axis X of the respective dry-gas extraction hole 35 and is substantially in counter-flow with respect to the direction of the main gas flow processed through the compressor 1. As used herein, "in counter-flow" means that velocity vectors of the two gas flows have respective velocity vector components, which are parallel to one another but oriented in opposite directions.

More specifically, in FIG. 1A arrow $F_M$ indicates the gas velocity vector of the main gas flow in the meridian plane, or radial plane, i.e. a plane containing the rotation axis A-A. In FIG. 3 arrow $F_T$ indicates velocity vector of the main gas flow in the tangential plane, i.e. the plane orthogonal to the rotation axis A-A.

As best shown in FIG. 4, with continuing reference to FIG. 3, the dry-gas velocity vector G can be split in a tangential velocity component $G_T$ and a radial velocity component $G_R$. The tangential velocity component $G_T$ is parallel to the tangential velocity vector $F_T$, but is oriented in the opposite direction. The dry-gas flow in dry-gas extraction hole 35 and the main gas flow in the curved end portion 21A of diffuser 21 are thus in counter-flow in the tangential plane.

Similarly, as shown in FIG. 5, with continuing reference to FIG. 1A, the meridian component $G_M$ of the dry-gas velocity vector can be split in a first component $G_1$ and a second component $G_2$ in the meridian plane. The first component $G_1$ of the dry-gas velocity vector in the meridian plane is parallel to the meridian velocity vector $F_M$ of the main gas flow, but is oriented in the opposite direction. Thus, the dry-gas flow ($G_M$) and the main gas flow ($F_M$) in the meridian plane are in counter-flow.

Since the liquid and/or solid particles drugged by the main gas flow have a density and therefore an inertia that are higher than the gas, these particles will continue to move in the tangential direction $F_T$ and in the meridian direction $F_M$, and will not deviate into the dry-gas extraction holes 35. The gas diverted from the main flow through the dry-gas extraction holes 35 is therefore substantially free of solid/liquid particles and impurities.

Figure 2:
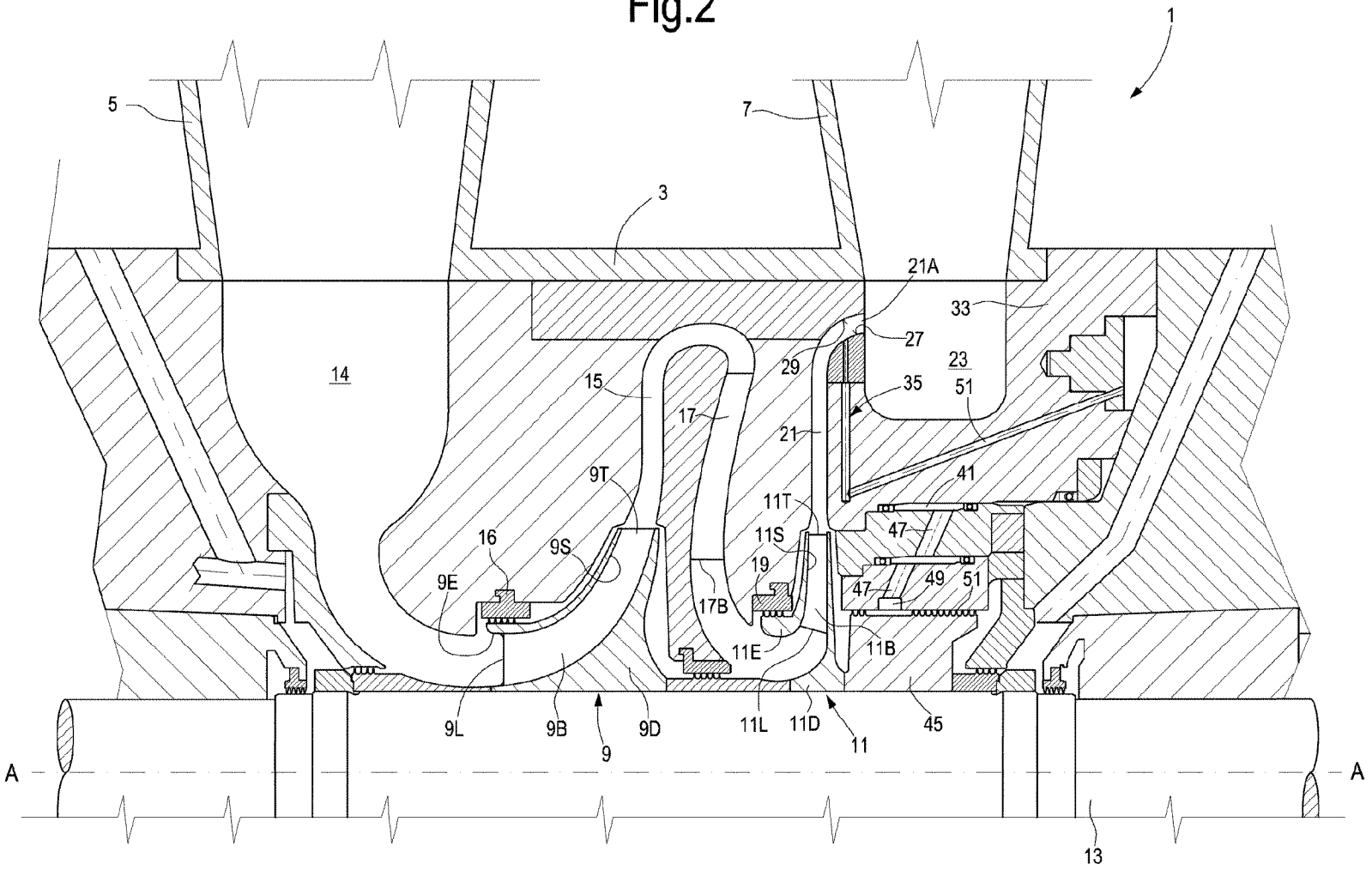
FIG. 2 illustrates a fragmentary sectional view of a centrifugal compressor according to the present disclosure in a further embodiment.

FIG. 2 illustrates a further embodiment of a centrifugal compressor embodying the subject matter disclosed herein. The same reference numbers indicate the same or equivalent parts and components as shown in FIGS. 1 and 3. These parts will not be described again.

The embodiment of FIG. 2 differs from embodiment of FIG. 1 in view of the different destination of the dry gas diverted from the main flow to the dry-gas extraction holes 35. In the embodiment of FIG. 2 the dry-gas extraction holes 35 are in fluid communication with an extraction passage 51, which leads towards the outside of the machine casing. In some embodiments the extraction passage 51 can be in fluid communication for example with a dry-gas seal skid not shown.

In other embodiments, not shown, the two configurations of FIGS. 1 and 2 can be combined. The dry gas diverted from the main flow through the dry-gas extraction holes 35 can be delivered partly towards shunt holes 49 and partly towards a seal gas extraction point, wherefrom the dry gas can be further processed and, if required, filtered and treated to be subsequently delivered to dry-gas sealing arrangements, the compressor 1 is provided with.

In more general terms, the dry-gas extraction holes 35 can be provided for extracting and delivering dry gas to any user requiring dry gas. In addition to providing dry gas for dry-gas seals and/or shunt holes, in some embodiments the dry gas extracted through the dry-gas extraction holes 35 can be used for active magnetic bearing cooling or electric motors cooling, for instance. A suitable number and arrangement of dry-gas extraction holes can be used for providing dry gas to different locations and auxiliaries, components, or elements of the turbomachine, in combination.

Figure 6:
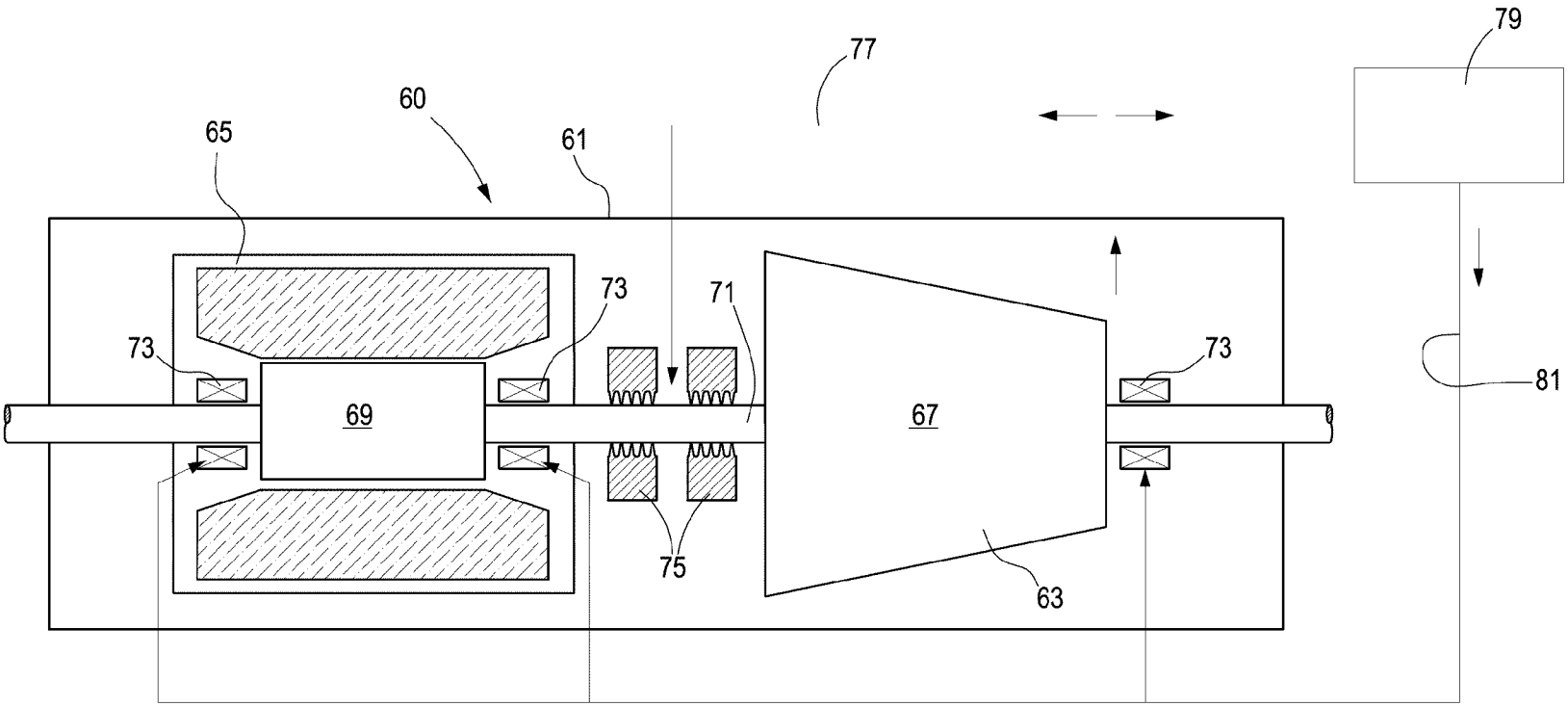
FIG. 6 illustrates a schematic of a motor-compressor comprised of a compressor section and an electric motor section for driving the compressor section into rotation.

FIG. 6 illustrates a schematic of a motor-compressor 60. The motor-compressor comprises a casing 61 divided into a first compartment 63 and a second compartment 65. The first compartment 63 houses a centrifugal compressor schematically shown at 67. The compressor 67 can be comprised of one or more impellers and respective diffusers, not shown in detail. A dry-gas extraction arrangement as described above can be provided in the compressor 67.

The second compartment 65 houses an electric motor 69. The electric motor 69 is drivingly connected to the compressor 67 by means of a shaft 71. The shaft 71 can be comprised or one or more shaft sections connected to one another e.g. by flexible joints or the like.

The motor-compressor 60 can comprise a plurality of bearings. In exemplary embodiments active magnetic bearings 73 can be provided at both ends of shaft 71 as well as in intermediate positions thereof.

A separating seal arrangement 75 can be arranged between the first compartment 63 and the second compartment 65, for separating the compressor from the electric motor. Buffer dry gas can be delivered to the separating seal arrangement 75, e.g. through a dry-gas supply line 77, which is fluidly coupled to a dry-gas extraction hole arrangement as described above.

In some embodiments a dry-gas seal skid 79 can be provided, for receiving dry gas from the dry-gas extraction holes in compressor 67 and distributing dry gas to one or more active magnetic bearings 73 through delivery lines 81.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

What is claimed is:

1. A wet-gas centrifugal compressor, the centrifugal compressor comprising:

a compressor casing;

at least one impeller arranged in the compressor casing for rotation around a rotation axis;

a stationary diffuser arranged in the compressor casing and developing around the impeller, the diffuser having a curved end portion with a radially inner curved wall and a radially outer curved wall; longitudinally, the inner curved wall having a smaller radius of curvature than the outer curved wall; and a plurality of dry-gas extraction holes, each provided with a respective inlet port, the inlet ports being arranged circumferentially on the inner curved wall of the curved end portion of the diffuser;

wherein each dry-gas extraction hole extends from the respective inlet port towards the rotation axis and is inclined over a radial direction, such that at least at the respective inlet port each dry-gas extraction hole is oriented in a counter-flow direction with respect to a direction of the gas flow in the curved end portion of the diffuser.

2. A wet-gas centrifugal compressor, the centrifugal compressor comprising:

a compressor casing;

a plurality of sequentially arranged impellers, arranged in the compressor casing for rotation around a rotation axis;

a respective stationary diffuser arranged in the compressor casing and developing around each impeller, each diffuser having a curved end portion with a radially inner curved wall and a radially outer curved wall; longitudinally, the inner curved wall having a smaller radius of curvature than the outer curved wall; and a plurality of dry-gas extraction hole provided with respective inlet ports, the inlet ports being arranged circumferentially on the inner curved wall of the curved end portion of the diffuser of the most downstream impeller;

wherein each dry-gas extraction hole extends from the respective inlet port towards the rotation axis and is inclined over a radial direction, such that at least at the respective inlet port each dry-gas extraction hole is oriented in a counter-flow direction with respect to a direction of the gas flow in the curved end portion of the diffuser.

3. The centrifugal compressor of claim 1, wherein the curved end portion of the diffuser, where the dry-gas extraction holes are arranged, is in direct fluid communication with a volute arranged and configured for collecting gas from the diffuser and conveying compressed gas towards a delivery duct of the centrifugal compressor.

4. The centrifugal compressor of claim 1, wherein the dry-gas extraction holes are formed in at least one removable component, mounted on a stationary diaphragm arranged in the compressor casing.

5. The centrifugal compressor of claim 1, wherein at least some of the dry-gas extraction holes are in fluid communication with a machine component requiring a dry-gas flow.

6. The centrifugal compressor of claim 1, wherein at least some of the dry-gas extraction holes are in fluid communication with a dry-gas seal skid.

7. The centrifugal compressor of claim 1, wherein at least some of the dry-gas extraction holes are in fluid communication with at least one dry-gas seal of the centrifugal compressor.

8. The centrifugal compressor of claim 1, wherein at least some of the dry-gas extraction holes are in fluid communication with at least one active magnetic bearing of the centrifugal compressor and providing a cooling flow to the active magnetic bearing.

9. The centrifugal compressor of claim 1, further comprising a balancing drum, which is provided with a seal arrangement with at least one shunt hole, wherein at least some of the dry-gas extraction holes are in fluid communication with the at least one shunt hole.

10. The centrifugal compressor of claim 1, wherein the compressor casing is divided into a first compartment, which houses the impeller(s) of the centrifugal compressor, and a second compartment, which houses an electric motor drivingly connected to the impeller(s) of the centrifugal compressor, the first and second compartments being separated by a separation arrangement; and wherein at least some of the dry-gas extraction holes are in fluid communication with the separation arrangement providing a buffering gas thereto.

11. The centrifugal compressor of claim 10, wherein the separation arrangement comprises at least one seal and wherein the buffering gas is delivered in or at the seal.

12. The centrifugal compressor of claim 10, wherein at least some of the dry-gas extraction holes are in fluid communication with the second compartment, for providing cooling dry gas for cooling the electric motor.

13. A method for providing a dry-gas flow to a component in a wet-gas centrifugal compressor comprised of: a compressor casing; at least one impeller arranged in the compressor casing for rotation around a rotation axis; a stationary diffuser arranged in the compressor casing and developing around the impeller, the diffuser having a curved end portion with a radially inner curved wall and a radially outer curved wall; longitudinally, the inner curved wall having a smaller radius of curvature than the outer curved wall; the method comprising the following:

providing a plurality of dry-gas extraction holes, each provided with a respective inlet port, the inlet ports being arranged circumferentially on the inner curved wall of the curved end portion of the diffuser; each dry-gas extraction hole extending from the respective inlet port towards the rotation axis and being inclined over a radial direction, such that at least at the respective inlet port each dry-gas extraction hole is oriented in a counter-flow direction with respect to a direction of the gas flow in the curved end portion of the diffuser;

extracting a dry-gas flow through the dry-gas extraction holes; and delivering the dry-gas to a component of the centrifugal compressor.

14. A method for providing a dry-gas flow to a component in a wet-gas centrifugal compressor comprised of: a compressor casing; a plurality of impellers arranged in the compressor casing for rotation around a rotation axis; for each impeller, a stationary diffuser arranged in the compressor casing and developing around the respective impeller, each diffuser having a curved end portion with a radially inner curved wall and a radially outer curved wall, in a sectional plane containing the rotation axis the inner curved wall having a smaller radius of curvature than the outer curved wall; the method comprising the following:

providing a plurality of dry-gas extraction holes, each provided with a respective inlet port, the inlet ports being arranged around the rotation axis and on the inner curved wall of the curved end portion of the most downstream one of the diffuser; each dry-gas extraction hole extending from the respective inlet port towards the rotation axis and being inclined over a radial direction, such that at least at the respective inlet port each dry-gas extraction hole is oriented in a counter-flow direction with respect to a direction of the gas flow in the curved end portion of the diffuser;

extracting a dry-gas flow through the dry-gas extraction holes; and delivering the dry-gas to a component of the centrifugal compressor.

15. The method of claim 13, wherein the component is selected from the group consisting of: a dry-gas seal; an active magnetic bearing; a balancing drum; a seal; and a compartment containing a motor drivingly connected to the impeller(s) of the centrifugal compressor.

16. The centrifugal compressor of claim 2, wherein the curved end portion of the diffuser, where the dry-gas extraction holes are arranged, is in direct fluid communication with a volute arranged and configured for collecting gas from the diffuser and conveying compressed gas towards a delivery duct of the centrifugal compressor.

17. The method of claim 14, wherein the component is selected from the group consisting of: a dry-gas seal; an active magnetic bearing; a balancing drum; a seal; and a compartment containing a motor drivingly connected to the impeller(s) of the centrifugal compressor.

18. The centrifugal compressor of claim 2, wherein the dry-gas extraction holes are formed in at least one removable component, mounted on a stationary diaphragm arranged in the compressor casing.

19. The centrifugal compressor of claim 2, wherein at least some of the dry-gas extraction holes are in fluid communication with at least one of: a machine component requiring a dry-gas flow, a dry-gas seal skid, at least one dry-gas seal of the centrifugal compressor, and at least one active magnetic bearing of the centrifugal compressor and providing a cooling flow to the active magnetic bearing.

20. The centrifugal compressor of claim 2, further comprising a balancing drum, which is provided with a seal arrangement with at least one shunt hole, wherein at least some of the dry-gas extraction holes are in fluid communication with the at least one shunt hole.

21. The centrifugal compressor of claim 2, wherein the compressor casing is divided into a first compartment, which houses the impeller(s) of the centrifugal compressor, and a second compartment, which houses an electric motor drivingly connected to the impeller(s) of the centrifugal compressor, the first and second compartments being separated by a separation arrangement; and wherein at least some of the dry-gas extraction holes are in fluid communication with the separation arrangement providing a buffering gas thereto.

* * * * *